US008113098B1

(12) United States Patent
Longfellow

(10) Patent No.: US 8,113,098 B1
(45) Date of Patent: Feb. 14, 2012

(54) AUTOMATED SHINGLE MILLING SYSTEM

(76) Inventor: James L. Longfellow, Windsor, ME (US)

( * ) Notice: Subject to any disclaimer, the term of this patent is extended or adjusted under 35 U.S.C. 154(b) by 700 days.

(21) Appl. No.: 12/325,075

(22) Filed: Nov. 28, 2008

(51) Int. Cl.
*B26D 3/00* (2006.01)

(52) U.S. Cl. ..... 83/75.5; 83/71; 83/364; 83/370; 83/371

(58) Field of Classification Search ..... 83/75.5, 83/425.4, 497, 508, 823, 71, 287, 364, 365, 83/370, 76.1, 311, 210, 371, 209, 72; 144/377, 144/3.1, 378, 379, 13; 356/376, 377, 384, 356/385
See application file for complete search history.

(56) References Cited

U.S. PATENT DOCUMENTS 2,791,249 A * 5/1957 Smith ..... 144/13
4,325,421 A * 4/1982 Janovick et al. ..... 144/377
4,640,160 A * 2/1987 Hards ..... 83/75.5
6,374,881 B1 * 4/2002 Wiklund et al. ..... 144/377
6,986,299 B2 * 1/2006 White et al. ..... 83/76.1

* cited by examiner

*Primary Examiner* — Ghassem Alie
(74) *Attorney, Agent, or Firm* — Patricia M. Mathers

(57) ABSTRACT

Saw mill for machine vision detection of undesirable features in the wood in shingles being cut from billets and automated optimized saw operation are disclosed. The saw mill includes a transport system that carries the billet through a butt-trimming saw, past a machine vision station, into an transition station for changing direction of travel of the billet and aligning the billet for travel into the subsequent gang rip saw station. The machine vision station determines any defects in the billet, grades the billet according to order-specific parameters, determines the optimal saw cut to maximize the value of the shingle, and sends control data to the gang rip saw controller, to position the saw blades for the optimal saw cut(s) for the shingle. A sorting system receives instructions from the visual imaging system and automatically shunts the product coming from the gang rip saw station into the appropriate container.

1 Claim, 10 Drawing Sheets

AUTOMATED SHINGLE MILLING SYSTEM

BACKGROUND INFORMATION

1. Field of the Invention

The invention relates to the field of saw mills. More particularly, the invention relates to shingle saw mills.

2. Description of the Prior Art

Definitions and usage: Shingles and shakes are relatively thin tapered slices of wood, typically cut from cedar logs. Each shingle has a butt, a top, two sides, and two planar faces. The thicker end of the tapered slice is the butt and the thin end the top. The side profile of the shingle is that of an isosceles triangle, with the two planar faces slanting from the butt to the top. The terms "shingle" and "shake" are often used interchangeably in the industry, and the term "shingle" shall be used hereinafter to encompass both the shingle and the shake.

The shingle industry has existed in the US for over 200 years. Producing a shingle from a log is a multi-step process, beginning with cutting a length of log that is slightly longer than the length of the finished shingle product, cutting a tapered rough blank or billet from a log, then squaring it up to a shingle by cutting a square butt edge and parallel side edges that are squared to the butt edge. A grading operation is performed manually, in which shingles are given a quality grade. There is no universal industry standard for this grading, so, for purposes of illustration only, an arbitrary grading system that defines quality grades #1 to #3 will be used in this specification. It should be understood, however, that the grading system may change according to order, with #1 identifying the highest quality grade and #3 the lowest acceptable grade. Thus, quality grade #3 may be different for an order that demands the highest quality from that of the standard order. Shingles that do not qualify as #3 are either discarded as waste or possibly cut for shims. The goal of this scanning operation is to maximize certain desirable characteristics or properties, such as size and/or quality, eliminate defective material, and reduce unnecessary waste.

As presently done, the sawyer receives a rough blank from the rough-billet saw, which may have live edges, that is, the round of the tree, still on the billet. The sawyer holds the shingle manually over an edging saw, with the butt placed against a flat support, and trims or edges first one side edge so that it is substantially perpendicular to the plane of the butt, flips the shingle, and trims the second side edge so that it is substantially parallel to the first side edge. These edges may not be perfectly square relative to the butt, so the shingles are typically sent through a re-squaring and re-butting machine, which "squares up" the shingle billet, that is, trims the sides so that they are perpendicular to the plane of the butt.

The conventional milling process results in significant and unnecessary removal of material from the width of the shingle, which reduces the amount of product or value that can be obtained from each log and increases the amount of waste product.

What is needed therefore is an automated process of grading, edging, rebutting, and sorting shingles. What is further needed is such a system that provides a safer work environment by reducing the exposure of the sawyer to saw blades. What is yet further needed is such a system that processes shingles faster and with much less waste production, and maximizes the amount of product that can be recovered from a log.

BRIEF SUMMARY OF THE INVENTION

The invention is an automated shingle milling system that automates several steps in the milling process and eliminates the manual rebutting step. The shingle milling system comprises a billet-cutting saw for cutting rough shingle billets from a log, a butt-trimming saw, a conveyor system, a visual imaging system for detecting properties, characteristics, or defects and optimizing the cutting operation, a gang rip saw for the final side-edging cut, and a sorting system.

Logs are first pre-cut into lengths that are slightly longer than the overall desired length of shingles. The billet-cutting saw passes through the pre-cut log, slicing off tapered, billets with live edges. In a side elevational view, the shape of the shingle billets is that of an isosceles triangle. The sides of the billets, at this stage, may be very irregular in shape. The billets are loaded into a magazine and from there pushed onto a conveyor system that feeds the billets through the butt-trimming saw, which square cuts the butt.

Upon exiting the butt-trimming saw, the shingle billet is conveyed past the visual imaging system, which scans both faces of the shingle billet. The imaging system confirms quality wood and knots, and also identifies knots and defects that should be removed. It does this by imaging the geometry of the side edges and the characteristics or defects on the face of the billet that have been defined to negatively affect the grade of the finished shingle product. Defects that are detectable by the visual imaging system include, but are not limited to, untrimmed edges, sound knots, unsound knots, holes in the shingle, and other defects. Unsound knots are wood knots that have a tendency to drop out of the shingle with time, whereas sound knots do not. The defect may be such, that the material that includes the defect has to be rejected (rotted material, unsound knots, holes), or it may be such, that the shingle with the defect will be deemed a lower quality product. Depending on the predetermined and selected quality standard, the defect may be allowed or deemed waste material.

The billet is then conveyed to the edging station. Based on information from the visual imaging system, a computer processing unit then calculates the best possible cut of the billet, to optimize its value and reduce waste. The shingle billet is fed onto centering apparatus, where it is oriented for a final cutting step by a gang rip saw having a plurality of saw blades. Depending on the location of defects in the billet, two or more saw blades are used to cut one or more shingles. Assuming, for example, that the gang rip saw has four saw blades and that an unsound knot is found in the center portion of the shingle. The two saw blades are positioned along the shaft so as to cut a shingle or a shim on each side of the unsound knot, and two are positioned to trim the edges. The material containing the unsound knot and the trimmed edges is discarded as waste material. The material to each side of the waste material is assigned a quality grade, for example, #1, #2, #3, or shim, and moved along the conveyor toward a sorting station. Ideally, automated sorting apparatus is provided at the outfeed of the rip saw, which drops the finished shingles into bins according to quality grade and shunts the waste material into a waste container.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

The invention is an automated shingle milling system 1000, which receives a shingle blank or billet that has gone through a first edging cut on the sides. The basic steps of the automated shingle milling system 1000 include: automatically precision cutting the butt end of the billet; imaging the billet faces 11 with a camera system to determine the ideal cuts to be made to maximize the quality of the final product and reduce waste; aligning the billet for passage through a gang rip saw, re-imaging the billet to ascertain exact position of the sides of the billet, and then sawing the billet according to instruction from the visual imaging system.

Figure 1:
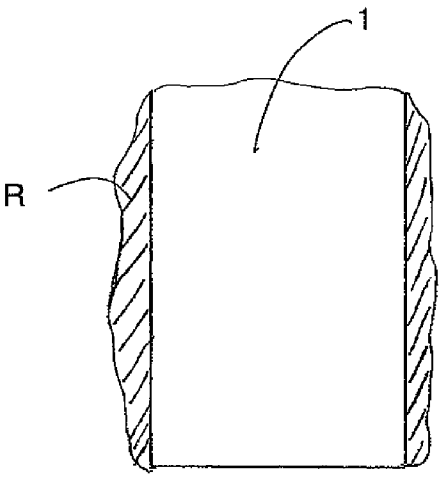
FIG. 1 is an illustration of a rough blank.
Figure 2:
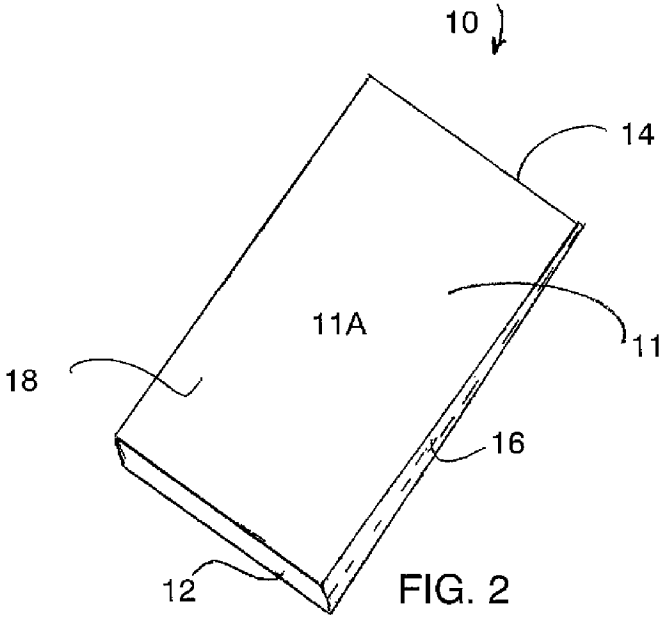
FIG. 2 is an illustration of a conventional finished-product shingle.

A shingle 10 starts off as a rough slice of wood, a rough blank 1, cut from a round log. FIG. 1 illustrates a rough blank, with round of tree R attached to the sides. FIG. 2 illustrates a finished product shingle 10. The shingle has a butt 12, a top 14, two sides 16, and two planar faces 11. The butt 12 is thicker than the top 14 and the plane of the butt 12 is cut perpendicular to an imaginary plane 18 that extends between the two faces from the butt to the top 11A, so as to create a shape that is an isosceles triangle. As used hereinafter, reference designation 10A shall designate a "blank", 10B shall designate a "butt-cut billet" or "butt-trimmed" billet, that is, the butt has been cut square relative to the imaginary plane 18, and 10C shall designate a finished-product shingle that has been cut according to pre-defined specifications to optimize the value of the finished product. The reference 12B shall designate a butt edge that has been squared by a butt saw and 12A a butt edge that has not yet been squared. The sides 16 are further defined as edged sides 16A, which still have the round of tree R on them, and trimmed sides 16B, which have gone through a final side-cut operation.

Figure 3A:
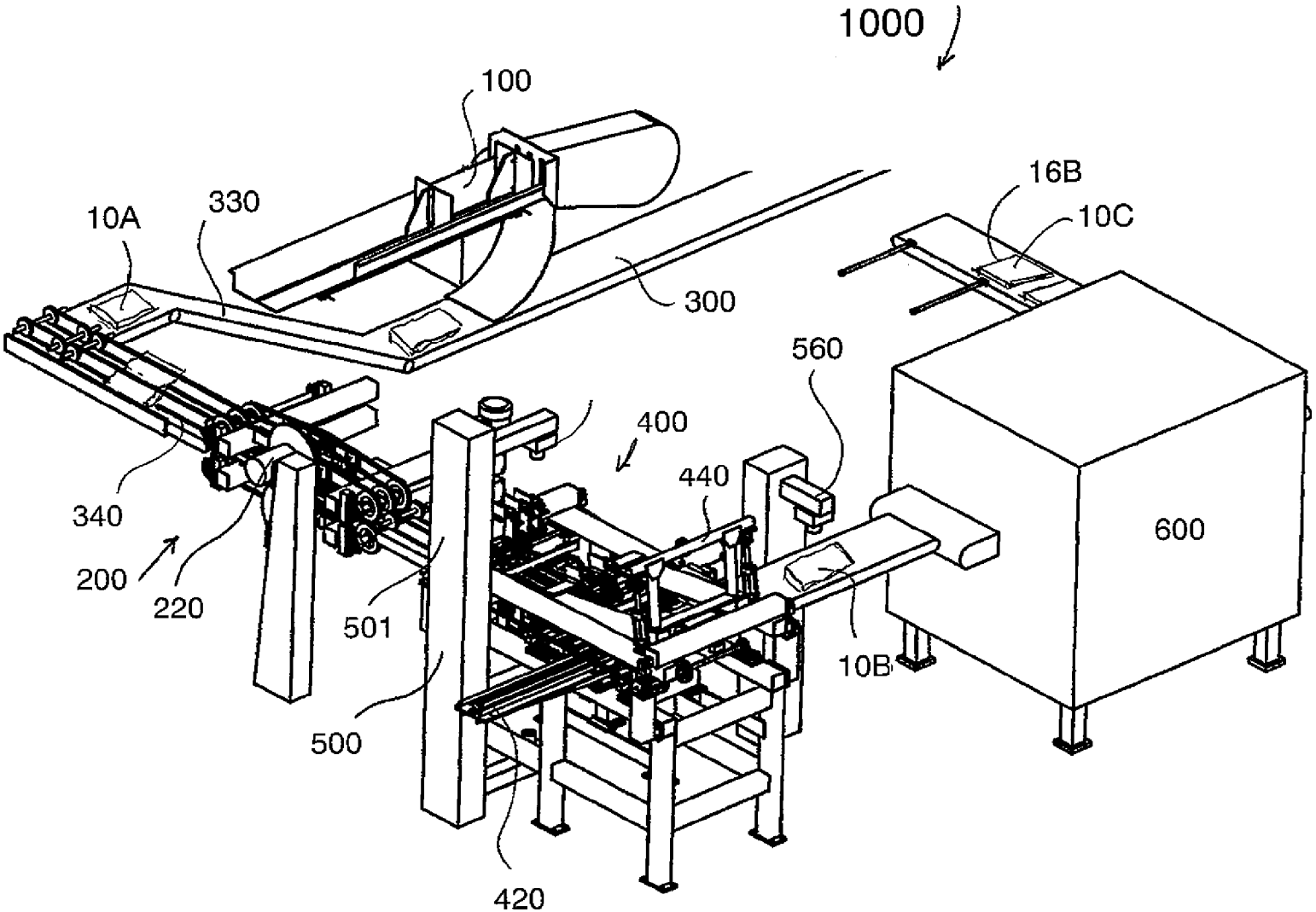
FIG. 3A is perspective view of the automated shingle milling system according to the invention.
Figure 3B:
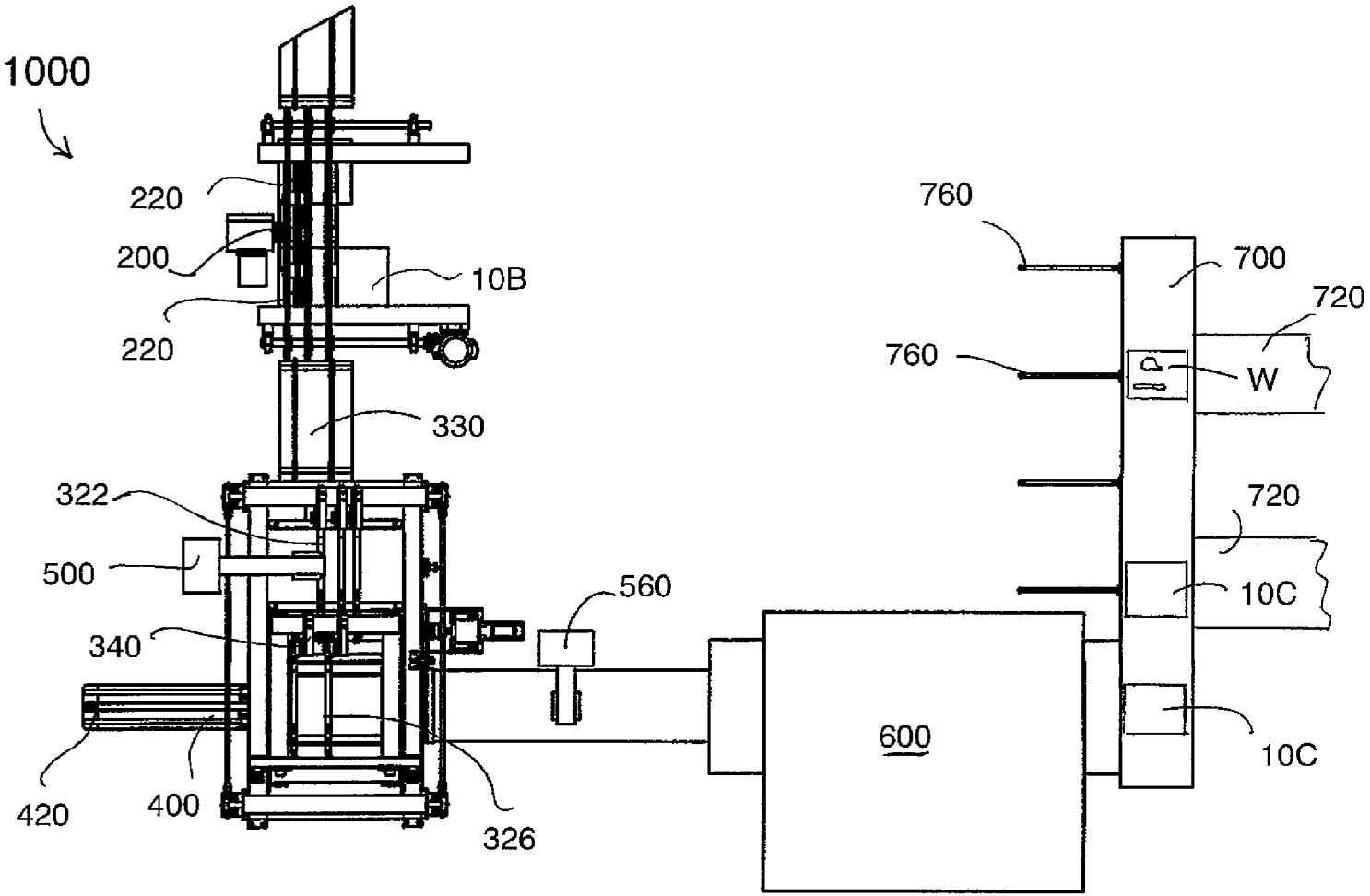
FIG. 3B is a top plane view of the automated shingle milling system.
Figure 3C:
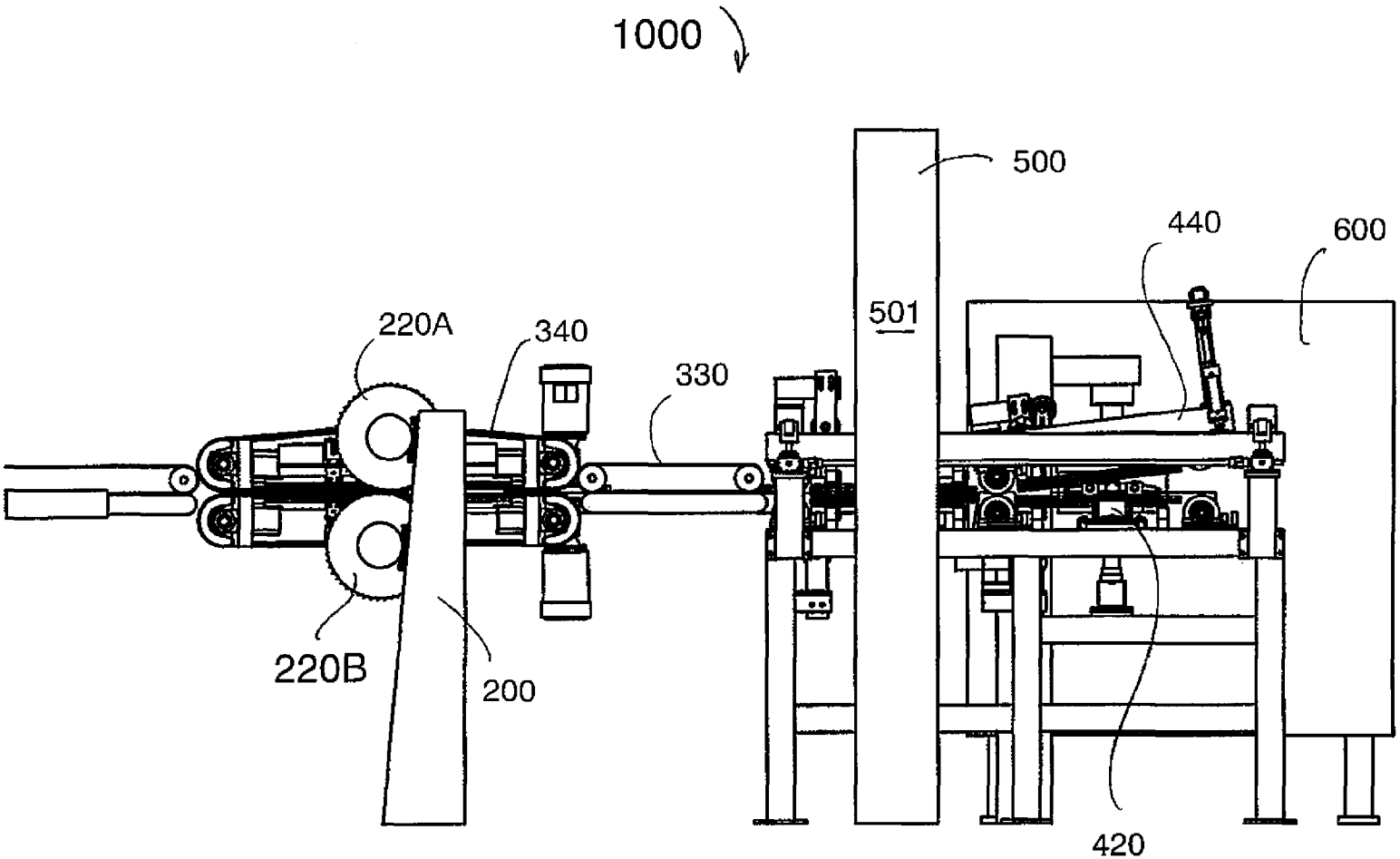
FIG. 3C is an elevational view of the automated shingle milling system.
Figure 4:
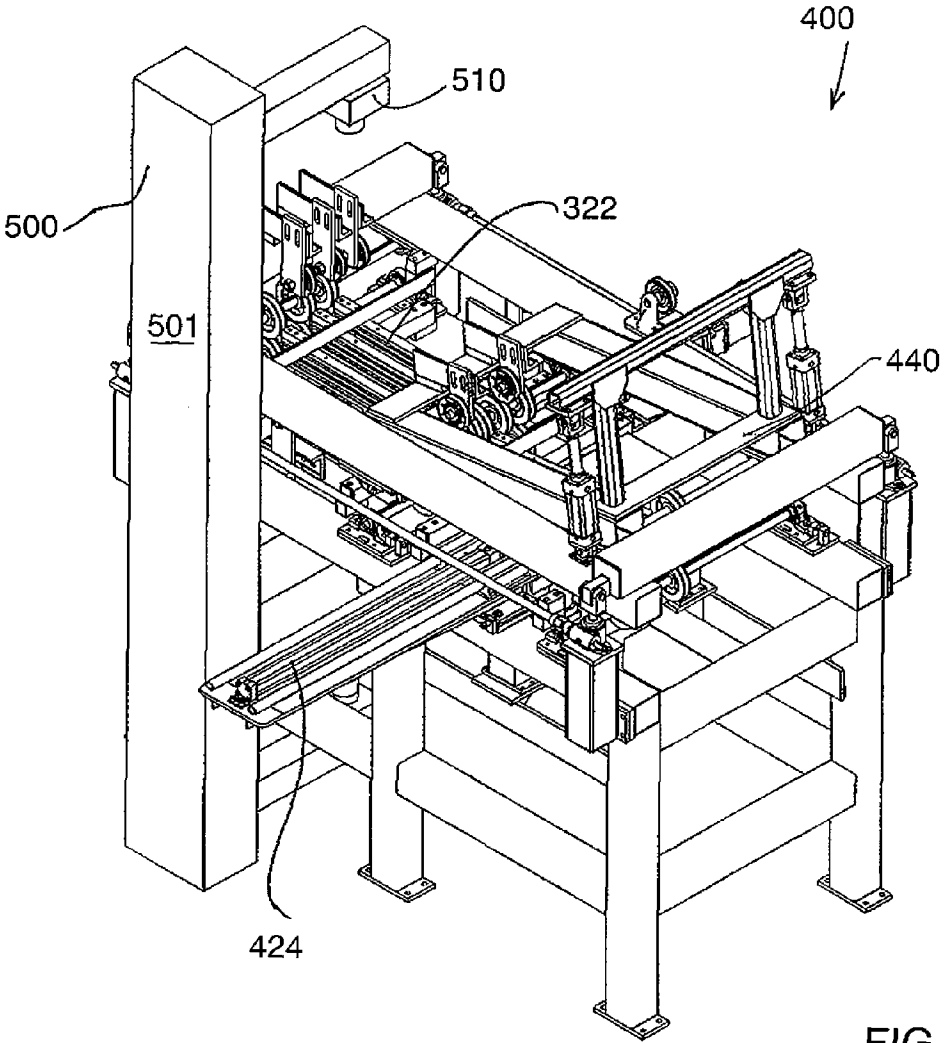
FIG. 4 is a perspective view of the visual imaging system and transition station.
Figure 5:
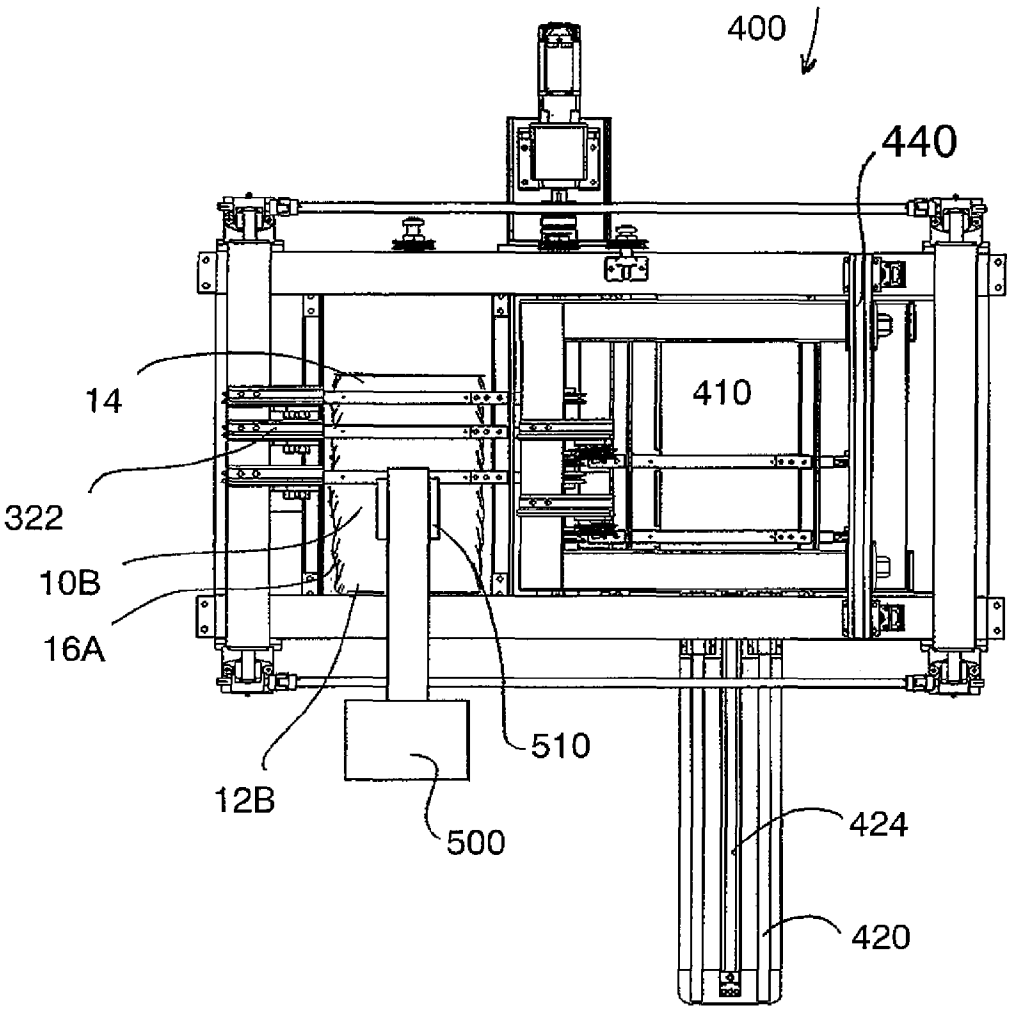
FIG. 5 is a top plane view of the visual imaging system and transition station, illustrating the alignment belts that move the billet past the imaging cameras and place the billet before the transition pusher.

FIGS. 3A-3C illustrate the automated shingle milling system 1000, FIG. 3A is a perspective view of the system; FIG. 3B is a top plane view, showing particularly the system of conveyor belts used to transport the billets; and FIG. 3C is a side elevational view showing particularly the butt saw 200. The automated shingle milling system 1000 comprises a magazine 100, a butt-saw 200, a billet-transport system 300, a billet-transition-and-aligning station 400, a visual imaging system 500, a gang rip saw station 600, and a sorting station 700. Blanks 10A are stored in the magazine 100 and from there forced out individually onto the billet-transport system 300. In the embodiment shown, the blank 10A is stored vertically in the magazine 100, with the butt edge 12A down. When forced out of the magazine 100 the blank falls onto one of its faces 11 and is moved toward the butt saw 200 along a conveyor belt 330. Belts 340, which run continuously and at the same speed as the conveyor belt 330 pick up the blank 10A and carry it over the butt saw 200, to square the butt 12. These belts 340 are similar in construction to the alignment belts 320 described below. In this embodiment, the butt saw 200 includes two saw blades 220 that are mounted vertically, one above the other, the blades offset slightly in the travel direction of the billet and slightly offset also in the direction transverse to the travel direction. The squared blank 10A is now moved along the billet-transport system 300 as the butt-squared billet 10B.

FIGS. 4-7 show various views of the transition station 400, along with the visual imaging system 500. The transition station 400 picks up the billet 10B after it has been squared, carries the billet 10B past the visual imaging system 500, and then aligns and pushes the billet 10B toward the gang rip saw station 600. Rather than using the conveyor belts 330, which are wide belts that transport unconstrained billets 10A-10C, the transition station 400 uses a plurality of alignment belts 320. It is difficult to transport the billet 10B with belts, because of its triangular shape and because. in the imaging process, a large portion of the billet has to be cantilevered out from the alignment belts, so that the belts to not interfere with the imaging. The inventor has discovered that POWERTWIST ROLLER DRIVE V-Belt by Fenner Drives is particularly well suited to grab the billet 10B and move it a horizontal plane. These alignment belts are segmented belts and the particular construction of the segments ensures that there is sufficient friction and compression against the billet to reliably move it forward. In the embodiment shown, two sets of alignment belts are used: a first set of belts 322, a second set of belts 326. These belts time the delivery of the billet 10B into the transition station 400. Each set of these alignment belts includes an upper belt run 322A and 326A, and a corresponding lower belt run 322B and 326B, respectively. A plurality of the first set of alignment belts 322 pick up the billet 10B at the top, i.e., thin, end off of the conveyor belt 330 downstream of the butt saw 200, and carry it past the visual imaging system 500, which will be discussed in greater detail below. It is the thicker end of the shingle 10, i.e., the six or more inches above the butt 12, that will be visible when shingles are hung as siding on a house wall or roof and so, it is the thicker end of the billet 10B that is graded by the visual imaging system 500. Grabbing the billet 10B across the top end 14 ensures that the graded end is completely visible for imaging. [check one more time for 324. Get rid of it.]

Figure 6:
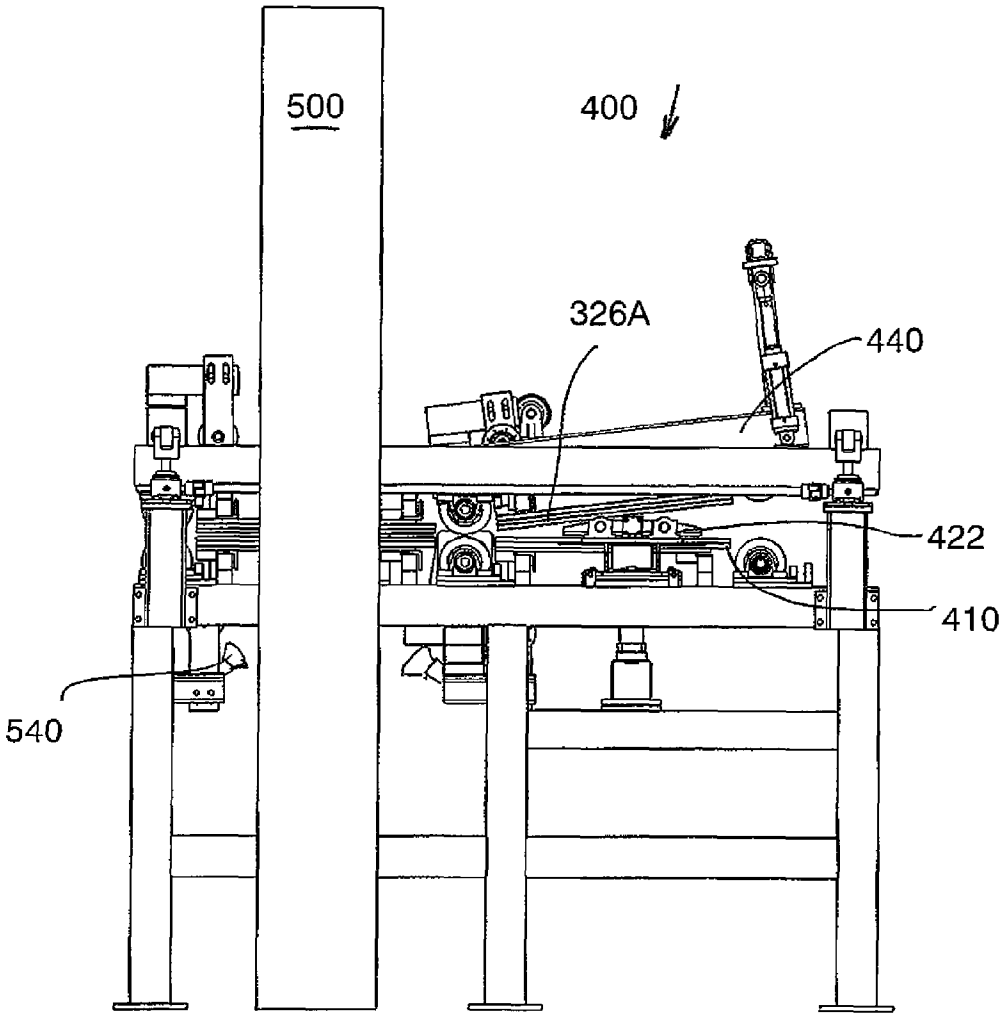
FIG. 6 is a side elevational view of the transition station, showing the upper alignment belts lifted from the billet and the support table raised.
Figure 7:
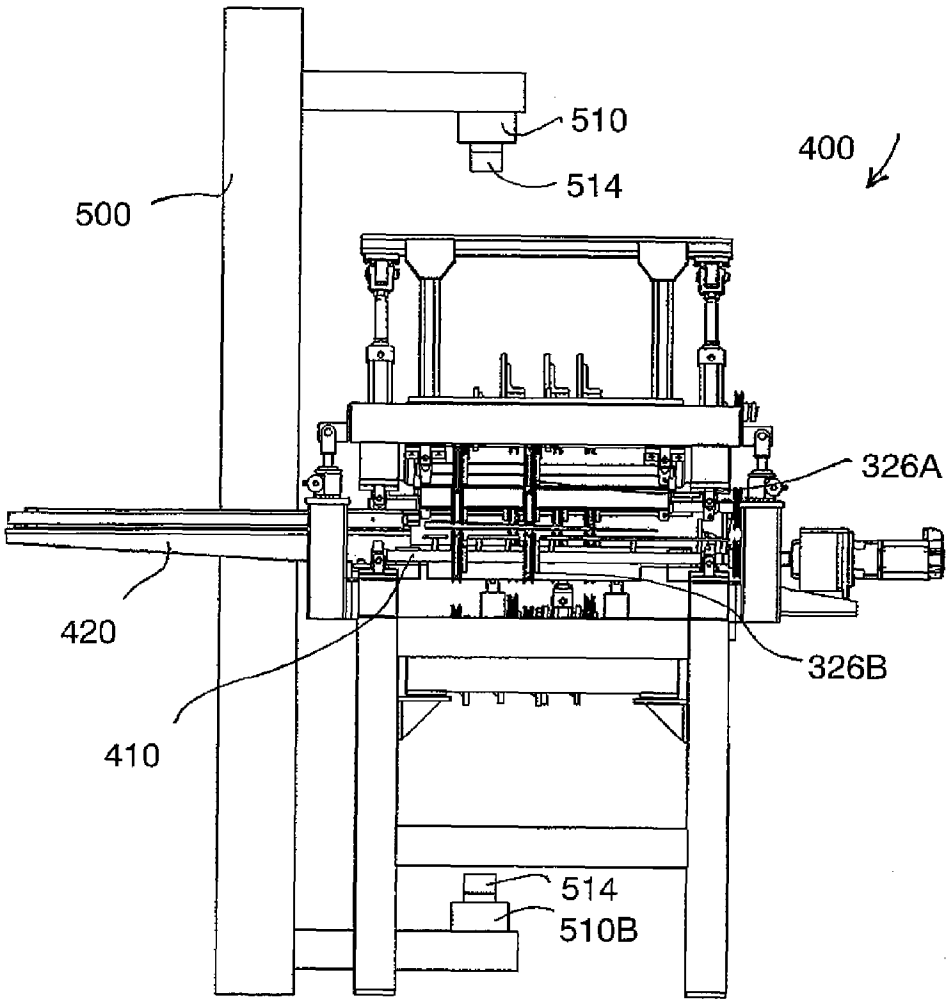
FIG. 7 is a plane view of the downstream end of the transition station, showing the pusher and the visual imaging system.

The first set of belts 322 moves the billet 10B past the visual imaging system 500 into the billet-transition-and-aligning station 400. Here the billet 10B is carried by the second set belts 326 onto a support platform 410. The support platform 410 is pneumatically controlled to rise and fall between a billet-receiving position, shown in FIG. 7, and an alignment position, shown in FIG. 6. A pusher 420 is mounted on the frame of the transition station 400. The pusher 420 has a pneumatically actuated cylinder 424 with a push-bar 422 at the end of it. The billet 10B is moved onto the support platform 410, which is in the receiving position. The upper run 326A of the third set of belts is attached to a lift frame 440. When the billet 10B is positioned on the support platform 410, the lift frame 440 is raised up, as shown in FIG. 6. This lifts the upper run 326A of belts from the billet. The support platform 410 is then raised, lifting the billet 10B off the lower belt run 326B and bringing the billet 10B into a position directly in front of the push-bar 422. The pneumatic cylinder 424 is actuated and the billet 10B is then pushed by the push-bar 422 out onto a conveyor belt 330 for transport to the gang rip saw station 600.

Figure 9:
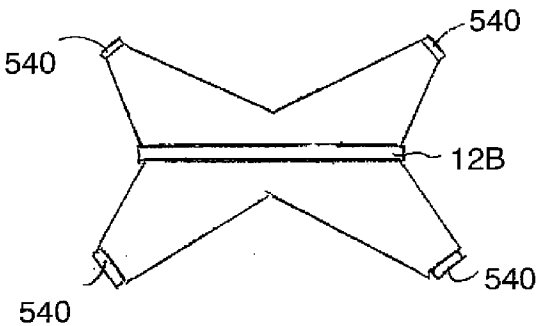
FIG. 9 is a schematic illustration of the auxiliary illumination of the billet.
Figure 8:
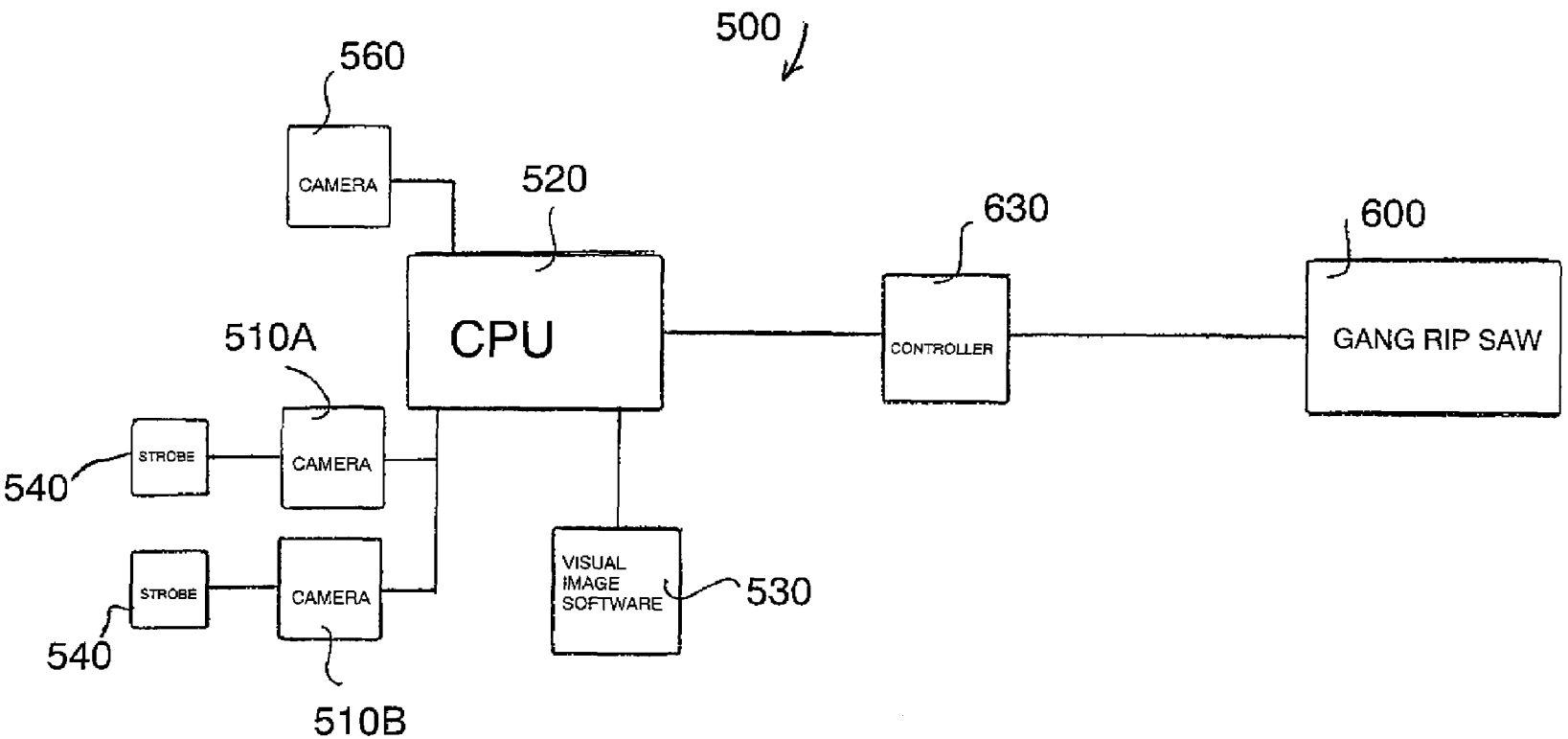
FIG. 8 is a block diagram of the visual imaging system.

FIGS. 8 and 9 illustrate elements of the visual imaging system 500, which comprises a camera 510, a CPU 520, vision software 530 that includes "blob tools" for identifying wood quality and determining the side cuts and software analytical tools and algorithms for combining and analyzing data acquired from the blob tools. The CPU 520 and storage means for the vision software 530 may be housed in a support column 501 for the visual imaging system or may be maintained at a remote location. In the preferred embodiment, the camera 510 includes two image-scanning cameras 510A and 510B, one for scanning each side of the billet 10B simultaneously. The camera 510 has a pixel sensor, preferably a high-resolution (1600×1200) sensor, coupled with an advanced digital signal processing (DSP) engine. A suitable lens 514 is used with the camera 510. The scope of the invention is not limited to the use of particular hardware components for the visual imaging system 500. Examples of suitable components include the Insight 5403 monochrome vision system, but preferably, a PC-based system that includes at least one high resolution digital camera, such as the IEEE 1394 High Resolution Camera or the Point Grey 2 MP Grasshopper black-and-white camera with Point Grey Development Accessory Kit, Cognex VisionPro Firewire 101. A suitable lens is the Fujinon 12.5 mm lens, although an 8.5 mm lens or other suitable lenses may also be used. Conventional IO modules (PLCs) for communicating between the CPU 520 and machine control devices, which are well known to the person of skill in the art are also included. An auxiliary lighting system 540 may be provided, as illustrated schematically in FIG. 9, to illuminate the billet 10B as it is imaged by the cameras 510. A suitable example of such a lighting system is the Advanced Illumination LL632-WHIC3D412 LED Line Light Assembly and Advanced Illumination S710 Pulsar High Current Strobe Controller. The strobe lights 540 are triggered just as the cameras 510 image the billet 10B.

The billet 10B may be presented to the visual imaging system 500, either in vertical or horizontal orientation, vertical orientation meaning that the billet 10B is standing on the butt edge 12B, horizontal orientation meaning that the billet 10B is carried in a horizontal orientation. In the embodiment shown, the billet 10B is transported in a horizontal orientation. The cameras 510 are mounted such, that the image-scanning cameras 510A and 510B image the billet 10B from above and from below, respectively. The auxiliary lighting system 540 is mounted to illuminate each face 11 of the billet 10B as the cameras 510A/510B scan the billet. FIG. 6 illustrates two strobe lights 540 set up to illuminate the lower surface 11B of the billet 10B. Upper strobe lights 540 may set up similarly on an upper portion of the support column 501 or on an upper portion of the frame of the billet-transition-and-aligning station 400. The strobe lights 540 are coupled to the camera control system and illuminate the billet 10B when the cameras fire. The cameras 510 may be controlled so that they fire a brief time apart from each other, to reduce background "noise", i.e., light pollution. A suitable configuration for the strobe lights 540 is shown in FIG. 9. If the billet 10B is presented in vertical orientation, the cameras would then, of course, be placed in front of and behind the billet. FindEdge software tools are used together with the pixel sensor 512 to locate the butt edge 12B. Once the butt edge 12B is located, the FindEdge tools are rotated 90 degrees to locate ideal side edges 16 on the billet 10B.

Defect detection in Northern White Cedar is generally difficult, because of the wide variation in types and sizes of defects, as well as the fact that the highest quality, i.e., clear wood, has a grain pattern. Nevertheless, certain aberrations in the wood grain are reliably recognizable by the visual imaging system 500 of the present invention. Typical wood grain pattern variations are usually subtle, that is, the variations in intensity between adjacent areas of clear wood are small and slow changing. Wood knots are typically darker than the surrounding clear wood and are predominantly round in shape, with a sharp delineation in intensity at the boundary between the knot and the clear wood. Bark rings surrounding knots are typically darker in color than the knot itself and much darker than the surrounding clear wood.

The visual imaging system 500 uses the software-based conventional "blob tools" to detect a defect in the billet 10B. The camera 510 images the faces 11A and 11B of the billet 10B. The blob tool analyzes the images and determines the existence of a blob by analyzing differences in intensity in adjacent pixels, a blob being a group of pixels of similar intensity that are readily distinguishable from the intensity of the pixels in the surrounding material. The blob tool recognizes only dark/light or foreground/background separation. A low-threshold blob tool detects the starkest differences in intensity, such as bark ring or holes, which are typically the darkest occurrences on a shingle. A high-threshold blob tool detects small variations in intensity between adjacent pixels, and a medium threshold blob tool detects dark features, such as whole knots. Thus, multiple applications of the logic with blob tools of varying thresholds are necessary to detect the various types of defects that occur: holes, knots with and without bark rings, colors, etc. The pixel locations of intensity variations that rise to the level of the threshold are used to generate a "defect map", which maps out the boundary of a defect and projects it onto a map of the billet. Data obtained from the boundary pixel locations allow the visual imaging system 500 to ascertain the perimeter, shape and size of a blob. Algorithms stored in the visual imaging system 500 analyze the data and determine whether the detected blob is, in fact, a defect, such as a knot, or simply "noise". These algorithms are variable, according to the specifications of the particular batch of shingles being processed. For example, some customers want shingles that contain sound knots, others want only clear wood. These parameters may be entered into the control panel, to adjust the grading definitions for the visual imaging system 500.

Figure 10:
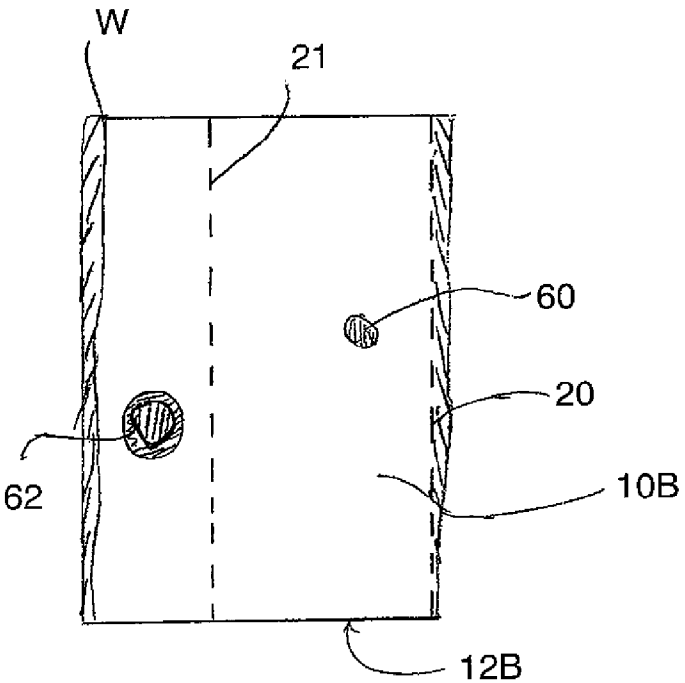
FIG. 10 is an illustration of knot defects on a billet.

FIG. 10 illustrates knot defects in a billet, including a sound knot 60 and an unsound knot 62. A knot is a blob-like dark area surrounded by light wood and readily discernible by blob tools. The knot may have both dark and light areas within the defined blob area, depending on whether it is a sound or an unsound knot. Whole knots generally are detectable by a blob tool using a medium intensity threshold. If the knot is a sound knot 60, that is, does not have a bark ring, this type of defect results in a reduction in quality grade from, for example, #1 to #2, but does not necessarily require elimination of the material. On the other hand, the unsound knot 62 has a bark ring surrounding the knot. The bark ring will shrink, weather, or degrade over time, to a greater degree than the surrounding wood as it dries, and consequently, the knot is likely to drop out of the shingle. Unsound knots result in either a degration of quality to the lowest grade, or the area of the billet 10B containing the unsound knot may be deemed to be waste W. As mentioned above, bark rings tend to be extremely dark features and are detectable by a low-threshold blob tool. Analysis of the combined results of low-threshold and medium-threshold blob tools provides a reliable indication whether the knot is sound or unsound, thereby allowing reliable grading of the shingle 10B. For example, if the visual imaging system 500 determines a knot using the medium threshold blob tool, but then does not find a bark ring using a low threshold blob tool, the knot is deemed a sound knot requiring quality degradation, for example, from grade #1 to grade #2. These grades are by way of illustration only. The grading system is arbitrary, defined by the individual mill management, and the parameters the correlate to grade #1, #2, etc. may be modified to correspond to the specific customer order.

The visual imaging system 500 merges the measurements taken by the blob tools onto the two-dimensional defect map, which corresponds in size and shape to the two-dimensional area of the billet. The visual imaging system 500 then post-processes the data on this two-dimensional map to determine which defects or characteristics affect the quality grade of a finished shingle product 10C and which result in waste W. Using this information, together with an optimization algorithm, the visual imaging system 500 then determines the best possible saw cuts 20 and 21 on the billet 10B to optimize the value of the finished shingle product 10C. As shown in FIG. 10, for example, the visual imaging system 500 has determined a first saw cut 20, to trim the outer edge to remove any live edge or round of tree and create a straight edge, and a second saw cut 21, to eliminate the unsound knot 62 and, again, to cut a straight second outer edge. The section containing the unsound knot 62 is determined to be waste W. The finished shingle 10C will be processed further on down the production line according to the quality grade determined by the visual imaging system 500.

Figure 11A:
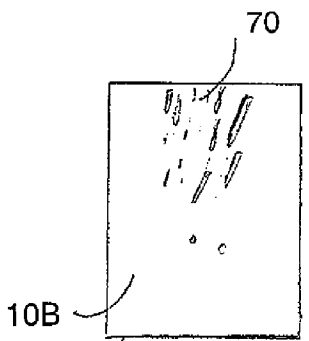
FIG. 11A is an illustration of a "shaky wood" defect.
Figure 11B:
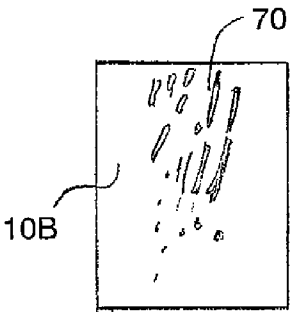
FIG. 11B is an illustration of the visual imaging system mapping of the "shaky wood" defect shown in FIG. 11A.

Some differences in intensity are detectable only with a high threshold blob tool, that is, the difference in intensity is not as stark or the area is not blob-like, as with a knot defect, are also mapped and identified as possible defects. FIGS. 11A and 11B illustrate a "shaky wood" defect 70 detected by the visual imaging system 500. Shaky wood typically has small depressions and holes in the wood, which are visually detectable as small high-contrast changes in intensity. A shingle 10 containing a shaky wood defect 70 is undesirable and frequently deemed waste. The visual imaging system 500 includes a neighborhood image filter tool, which detects such high-contrast changes and which then produces a black-and-white map of such small, high-contrast changes, with the high-contrast changes shown as bright white areas on black. The areas containing such high-contrast changes are shown as brighter than the background, i.e., the surrounding normal wood grain pattern. FIG. 11B is a schematic illustration of the enhanced contrast imaging. The data acquired by the neighborhood image filter tool undergoes post-processing and feature detection/This is a loop processing, in which the edges are defined first, and then in a reiterative process first clear wood is defined, then sound knots, then unsound knots, then holes, shaky wood, etc. After steps, the data from this high-contrast map and the post processing are incorporated into the defect map. The defect map now contains data relating to all types of detected defects or wood characteristics that influence the quality grading. The visual imaging system 500 determines the grade and optimal cut of the billet 10B, based on this defect map.

Once the butt-trimmed billet 10B has gone through detection by the visual imaging system 500, it is aligned and moved on toward the billet-transition-and-aligning station 400, described above. The billet 10B is aligned and pushed by the push-bar 422 out onto the conveyor 330, in the direction of the gang rip saw station 600. A third camera 560 scans the upper surface of the butt-trimmed billet 10B, to determine precisely where the edges of the billet are. The visual imaging system 500 matches and aligns the image from the third camera 560 with the image previously obtained with the first and second cameras 510A/510B and sends data to a rip-saw controller 630, in order to control the positioning of saw blades 612 in relation to defects or undesirable characteristics in the billet.

Figure 12:
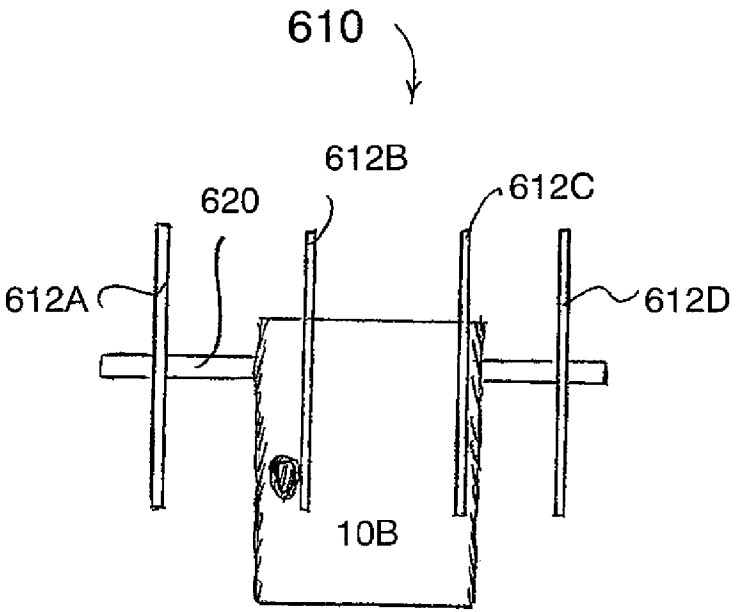
FIG. 12 is a schematic illustration of the gang rip saw.

FIG. 12 is an illustration of the gang rip saw 610, which comprises a set of saw blades 612A-612D mounted on an arbor 620. A gang rip saw controller 630 receives instructions from the visual imaging system 500 as to what areas on the sides of the butt-trimmed billet 10B are to be trimmed. The individual saws 612 are then shifted along the arbor 620, so that they are in a position to cut the billet 10B according to instructions. Referring again to FIG. 10, the visual imaging system 500 has determined that cuts 20 and 21 should be made. Two of the saws 612B and 612C are moved into position to effect these two cuts. The outer saws, 612A and 612D remain beyond the range of the billet 10B if they are not needed for a cut. The shingle emerging from the gang rip saw station 60 is now a finished shingle 10C. An example of a gang rip saw that is suitable for this purpose is a gang rip saw from the company [Mereen-Johnson, Model 4300-DCS/SR-4 "Select-a-Rip". This saw is a conventional saw that has a modified in-feed so as to accept the triangular shape of the shingle and still grip it. Transport means for carrying the billet under the saw blades is a dip chain, a flat segmented approximately 3" wide chain or belt, with a rubber surface that grabs the billet.

The finished shingle 10C is pushed onto a last section of the conveyor system 300 toward the sorting station 700. The sorting station 700 includes a series of actuators 760 and a series of containers 720 for collecting the final product or waste. The actuators 760 shown in FIG. 3B are push bars, but other suitable means, such as electrically controlled trap doors that open into containers, or chutes with electrically controlled gates, etc. The containers 720 include a conveyor that carries the product or the waste material into a large container. The controller for the sorting station 700 receives data on the approaching shingle 10C and actuates the appropriate actuator 760, which forces the finished product 10C or waste W into the appropriate container.

It is understood that the embodiments described herein are merely illustrative of the present invention. Variations in the construction of the automated shingle milling system may be contemplated by one skilled in the art without limiting the intended scope of the invention herein disclosed and as defined by the following claims.

What is claimed is:

1. An Apparatus for automatically producing a shingle from a rough billet, a shingle having a butt, a top, two sides, and two faces, said apparatus comprising:

a conveyor system having conveyor belts and alignment belts for transporting the billet;

a butt-trimming saw for squaring the butt of the billet;

a visual imaging system for scanning each of the two faces of the billet;

a transition station that receives the billet from the butt-trimming saw; and a gang rip saw comprising a plurality of saw blades mounted on an arbor that is common to the plurality of saw blades;

wherein the conveyor system transports the billet past the butt-trimming saw and the visual imaging system, into the transition station and on through the gang rip saw station;

wherein the visual imaging system scans each of the two faces and maps location and size of defects or characteristics onto a defect map for the billet, then generates sawing instructions for the gang rip saw station to maximize the value of a finished shingle, based on data generated from the defect map;

wherein the transition station re-aligns the billet and pushes the billet onto a rip-saw conveyor which carries the billet into the gang rip saw station;

wherein the visual imaging system has an additional camera that images the billet on the rip-saw conveyor, compares this image with the defect map, determines the precise position of the billet relative to the gang rip saw, and sends saw instructions to the gang rip saw; and wherein the plurality of saw blades are adjusted along the arbor, for sawing the billet into a finished shingle, based on the saw instruction from the visual imaging system.

* * * * *